US007179782B2

(12) United States Patent
Gibbs et al.

(10) Patent No.: US 7,179,782 B2
(45) **Date of Patent: *Feb. 20, 2007**

(54) DETERGENT COMPOSITIONS

(75) Inventors: Christopher David Gibbs, Bebington (GB); Alyn James Parry, Bebington (GB); Susanne Henning Rogers, Bebington (GB)

(73) Assignee: Unilever Home & Personal Care USA, Division of Conopco, Inc., Greenwich, CT (US)

( * ) Notice: Subject to any disclaimer, the term of this patent is extended or adjusted under 35 U.S.C. 154(b) by 386 days.

This patent is subject to a terminal disclaimer.

(21) Appl. No.: 10/759,417

(22) Filed: Jan. 16, 2004

(65) Prior Publication Data

US 2004/0152619 A1 Aug. 5, 2004

(30) Foreign Application Priority Data

Jan. 16, 2003 (GB) ..... 0301022.0

(51) Int. Cl.
*C11D 3/22* (2006.01)
*C11D 3/37* (2006.01)
*B08B 3/04* (2006.01)

(52) U.S. Cl. ..... 510/475; 510/276; 510/470; 510/473; 8/137

(58) Field of Classification Search ..... None
See application file for complete search history.

(56) References Cited

U.S. PATENT DOCUMENTS

| | | | | |
|---|---|---|---|---|
| 4,235,735 | A | 11/1980 | Marco et al. | 252/174.18 |
| 6,288,022 | B1 | 9/2001 | Clark et al. | 510/470 |

FOREIGN PATENT DOCUMENTS

| | | |
|---|---|---|
| EP | 936 224 | 8/1999 |
| WO | 00/18861 | 4/2000 |
| WO | 00/18862 | 4/2000 |
| WO | 01/88075 | 11/2001 |
| WO | 2003/10267 | 2/2003 |

OTHER PUBLICATIONS

Co-pending U.S. Appl. No. 10/484,295, filed Jan. 20, 2004. Rogers et al.
Co-pending U.S. Appl. No. 10/484,392, filed Jan. 20, 2004. Blokzijl et al.
Co-pending U.S. Appl. No. 09/409,169, filed Sep. 30, 1999. Clark et al.
PCT International Search Report in a PCT application PCT/EP 03/14522.

*Primary Examiner*—Necholus Ogden
(74) *Attorney, Agent, or Firm*—Rimma Mitelman

(57) ABSTRACT

Incorporation in a laundry detergent composition of a graft polymer having a locust bean gum backbone and grafts of an aromatic sulphonic acid improves antiredeposition properties. The preferred polymer is locust bean gum—graft—poly (4-styrenesulphonic acid).

8 Claims, No Drawings

DETERGENT COMPOSITIONS

TECHNICAL FIELD

The present invention relates to laundry detergent compositions containing certain graft polymers that can reduce redeposition of soil onto fabrics during the wash process.

BACKGROUND AND PRIOR ART

During the laundry process in a domestic or commercial washing machine, soil is removed from the soiled fabrics by a combination of the physical action (agitation) of the machine and the detergency of the laundry detergent composition, and enters the wash liquor. A similar process occurs in handwashing. It is important to ensure that soil is not simply deposited back onto the fabrics but remains suspended in the wash liquor and eventually washed away. Laundry detergent compositions conventionally contain sodium carboxymethyl cellulose (SCMC) as an antiredeposition agent. U.S. Pat. No. 4,235,735 (Marco et al/Milliken) discloses cellulose acetates with a defined degree of substitution as antiredeposition agents in laundry detergent compositions.

Other cellulosic materials have also been used in laundry detergent compositions for a variety of benefits, for example, soil release, and fabric care benefits.

WO 00/18861A and WO 00/18862A (Unilever) disclose cellulosic compounds having a benefit agent attached, so that the benefit agent will be deposited on the fibres of the washed textiles during the laundry process.

Our pending international patent application PCT/EP02/07682 filed on 10 Jul. 2002 discloses the use in laundry compositions of grafted polysaccharides prepared by a controlled process, the atom transfer radical polymerisation process. The polymers can give various benefits, notably soil release and fabric care benefits. Amongst the polymers disclosed as giving fabric care benefits is a polymer having a locust bean gum backbone and grafts of styrene-4-sulphonic acid.

DEFINITION OF THE INVENTION

The present invention provides a built laundry detergent composition comprising (a) from 5 to 60 wt % of an organic detergent surfactant selected from anionic, nonionic, cationic, zwitterionic and amphoteric surfactants and combinations thereof, (b) from 10 to 80 wt % of a detergency builder, (c) from 0.1 to 10 wt % of a graft polymer having a locust bean gum backbone and grafts of an aromatic sulphonic acid, (d) optionally other detergent ingredients to 100 wt %.

The present invention further provides a particulate laundry detergent-composition comprising (a) from 5 to 60 wt % of an organic detergent surfactant selected from anionic, nonionic, cationic, zwitterionic and amphoteric surfactants and combinations thereof, (b) optionally from 0 to 80 wt % of a detergency builder, (c) from 0.1 to 10 wt % of a graft polymer having a locust bean gum backbone and grafts of an aromatic sulphonic acid, (d) optionally other detergent ingredients to 100 wt %.

DETAILED DESCRIPTION OF THE INVENTION

The Graft Polymer

The graft polymer which is used in accordance with the invention to improve the antiredeposition properties of a laundry detergent composition is a polymer having a backbone of locust bean gum. Locust bean gum is a naturally occurring galactomannan polysaccharide having a beta-1,4-linked backbone.

The total number of sugar units is preferably from 50 to 7000, and the preferred molecular weight is from 10 000 to 1 000 000.

In the graft polymer at least one sugar unit of the polysaccharide has been substituted with groups derived from an aromatic sulphonic acid, preferably styrene 4-sulphonic acid.

Thus the preferred graft polymer used in accordance with the invention is locust bean gum—graft—poly(4-styrene-sulphonic acid).

Preparation of the Graft Polymer

The graft polymer may be prepared by any suitable process. However, according to a preferred embodiment of the invention, the polymer is prepared by the "living polymerisation" technique of atom transfer radical polymerisation (ATRP), as described and claimed in our International Patent Applications Nos. PCT/EP02/07682 and PCT/EP02/07683 filed on 10 Jul. 2002.

The Laundry Detergent Composition

The graft polymer is suitably incorporated in laundry detergent compositions in an amount of from 0.1 to 10 wt %, preferably from 0.5 to 5 wt %.

Built laundry detergent compositions utilising the graft polymer comprise:

(a) from 5 to 60 wt % of an organic detergent surfactant selected from anionic, nonionic, cationic, zwitterionic and amphoteric surfactants and combinations thereof, (b) optionally from 0 to 80 wt % of a detergency builder, (c) from 0.1 to 10 wt % of the locust bean gum graft polymer, (d) optionally other detergent ingredients to 100 wt %.

These compositions may be of any physical form for example, powder, tablet, liquid, gel, paste or bar.

Most preferably the laundry detergent composition is a granular or particulate composition, especially a powder or a tablet; or a liquid.

Particulate laundry detergent compositions in accordance with the invention comprise:

(a) from 5 to 60 wt % of an organic detergent surfactant selected from anionic, nonionic, cationic, zwitterionic and amphoteric surfactants and combinations thereof, (b) optionally from 0 to 80 wt % of a detergency builder, (c) from 0.1 to 10 wt % of a graft polymer having a locust bean gum backbone and grafts of an aromatic sulphonic acid, (d) optionally other detergent ingredients to 100 wt %.

The Organic Detergent Surfactant

Detergent-active compounds (surfactants) may be chosen from soap and non-soap anionic, cationic, nonionic, amphoteric and zwitterionic detergent-active compounds, and mixtures thereof. Many suitable detergent-active compounds are available and are fully described in the literature, for example, in "Surface-Active Agents and Detergents", Volumes I and II, by Schwartz, Perry and Berch. The preferred detergent-active compounds that can be used are soaps and synthetic non-soap anionic and nonionic compounds. The total amount of surfactant present is suitably within the range of from 5 to 60 wt %, preferably from 5 to 40 wt %.

Anionic surfactants are well-known to those skilled in the art. Examples include alkylbenzene sulphonates, particularly linear alkylbenzene sulphonates having an alkyl chain length of $C_8$–$C_{15}$; primary and secondary alkylsulphates, particularly $C_8$–$C_{20}$ primary alkyl sulphates; alkyl ether sulphates; olefin sulphonates; alkyl xylene sulphonates; dialkyl sulphosuccinates; and fatty acid ester sulphonates. Sodium salts are generally preferred. Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkanolamides, alkylpolyglycosides, glycerol monoethers, and polyhydroxyamides (glucamide).

Cationic surfactants that may be used include quaternary ammonium salts of the general formula $R_1R_2R_3R_4N^+X^-$ wherein the R groups are long or short hydrocarbyl chains, typically alkyl, hydroxyalkyl or ethoxylated alkyl groups, and X is a solubilising anion (for example, compounds in which $R_1$ is a $C_8$–$C_{22}$ alkyl group, preferably a $C_8$–$C_{10}$ or $C_{12}$–$C_{14}$ alkyl group, $R_2$ is a methyl group, and $R_3$ and $R_4$, which may be the same or different, are methyl or hydroxyethyl groups); and cationic esters (for example, choline esters).

Amphoteric and zwitterionic surfactants that may be used include alkyl amine oxides, betaines and sulphobetaines. In accordance with the present invention, the detergent surfactant (a) most preferably comprises an anionic sulphonate or sulphonate surfactant optionally in admixture with one or more cosurfactants selected from ethoxylated nonionic surfactants, non-ethoxylated nonionic surfactants, ethoxylated sulphate anionic surfactants, cationic surfactants, amine oxides, alkanolamides and combinations thereof.

Surfactants are preferably present in a total amount of from 5 to 60 wt %, more preferably from 10 to 40 wt %.

The Detergency Builder

Preferred inorganic builders are alkali metal aluminosilicates, more especially crystalline alkali metal aluminosilicates (zeolites), preferably in sodium salt form.

Zeolite builders may suitably be present in a total amount of from 5 to 60 wt %, preferably from 10 to 50 wt %.

The zeolites may be supplemented by other inorganic builders, for example, amorphous aluminosilicates, or layered silicates such as SKS-6 ex Clariant.

The zeolites may be supplemented by organic builders, for example, polycarboxylate polymers such as polyacrylates and acrylic/maleic copolymers; monomeric polycarboxylates such as citrates, gluconates, oxydisuccinates, glycerol mono-, di- and trisuccinates, carboxymethyloxysuccinates, carboxymethyloxymalonates, dipicolinates, hydroxyethyliminodiacetates, alkyl- and alkenylmalonates and succinates; and sulphonated fatty acid salts.

Alternatively, the compositions of the invention may contain phosphate builders, for example, sodium tripolyphosphate.

Especially preferred organic builders are citrates, suitably used in amounts of from 1 to 30 wt %, preferably from 2 to 15 wt %; and acrylic polymers, more especially acrylic/maleic copolymers, suitably used in amounts of from 0.5 to 15 wt %, preferably from 1 to 10 wt %. Builders, both inorganic and organic, are preferably present in alkali metal salt, especially sodium salt, form.

Builders are suitably present in total amounts of from 10 to 80 wt %, more preferably from 20 to 60 wt %. Builders may be inorganic or organic.

A built composition in accordance with the invention may most preferably comprise from 10 to 80 wt % of a detergency builder (b) selected from zeolites, phosphates, and citrates.

Other Detergent Ingredients

The laundry detergent composition will generally comprises other detergent ingredients well known in the art. These may suitably be selected from bleach ingredients, enzymes, sodium carbonate, sodium silicate, sodium sulphate, foam controllers, foam boosters, perfumes, fabric conditioners, soil release polymers, dye transfer inhibitors, photobleaches, fluorescers and coloured speckles.

Detergent compositions in accordance with the invention may also suitably contain a bleach system. Preferably this will include a peroxy bleach compound, for example, an inorganic persalt or an organic peroxyacid, capable of yielding hydrogen peroxide in aqueous solution.

Preferred inorganic persalts are sodium perborate monohydrate and tetrahydrate, and sodium percarbonate, the latter being especially preferred. The sodium percarbonate may have a protective coating against destabilisation by moisture. The peroxy bleach compound is suitably present in an amount of from 5 to 35 wt %, preferably from 10 to 25 wt %.

The peroxy bleach compound may be used in conjunction with a bleach activator (bleach precursor) to improve bleaching action at low wash temperatures. The bleach precursor is suitably present in an amount of from 1 to 8 wt %, preferably from 2 to 5 wt %. Preferred bleach precursors are peroxycarboxylic acid precursors, more especially peracetic acid precursors and peroxybenzoic acid precursors; and peroxycarbonic acid precursors. An especially preferred bleach precursor is N,N,N',N'-tetracetyl ethylenediamine (TAED).

A bleach stabiliser (heavy metal sequestrant) may also be present. Suitable bleach stabilisers include ethylenediamine tetraacetate (EDTA), diethylenetriamine pentaacetate (DTPA), ethylenediamine disuccinate (EDDS), and the polyphosphonates such as the Dequests (Trade Mark), ethylenediamine tetramethylene phosphonate (EDTMP) and diethylenetriamine pentamethylene phosphate (DETPMP).

Compositions of the invention in particulate form may contain alkali metal, preferably sodium, carbonate, in order to increase detergency and ease processing. Sodium carbonate may suitably be present in amounts ranging from 1 to 60 wt %, preferably from 2 to 40 wt %.

As previously indicated, sodium silicate may also be present. The amount of sodium silicate may suitably range from 0.1 to 5 wt %.

Preparation of Particulate Detergent Composition

Particulate detergent compositions are suitably prepared by spray-drying a slurry of compatible heat-insensitive ingredients in a spray-drying tower, and then spraying on or postdosing those ingredients unsuitable for processing via the slurry. The skilled detergent formulator will have no difficulty in deciding which ingredients should be included in the slurry and which should not.

If a high bulk density is desired, the spray-dried detergent composition may be subjected to post-tower densification using, for example, a high-speed mixer/granulator. Alternatively, particulate detergent compositions may be prepared by wholly non-tower mixing and granulation processes. In both cases a high-speed mixer/granulator may advantageously be used.

EXAMPLES

The invention is further illustrated by the following non-limiting Examples, in which parts and percentages are by weight unless otherwise stated.

Example 1

Synthesis of Grant Polymer 1.1 Preparation of Locust Bean Gum Macroinitiator A 9% w/v solution of lithium chloride (LiCl) in N,N-dimethylsulphoxide (DMSO) was prepared by heating 18 g of LiCl in 200 $cm^3$ of anhydrous DMSO to 150° C. in a 2-necked round bottom flask fitted with an overhead stirrer. Once a homogeneous solution had been obtained, Locust Bean Gum (LBG, MUD 246B ex Rhodia) (10 g, 0.062 mol of anhydromannose/galactose unit) was added to the solution gradually, maintaining the temperature at 150° C. until a highly viscous, clear, yellow solution had formed. This solution was then cooled to 65° C.

In a separate beaker, a solution of 2-bromoisobutyric acid (10 g, 0.06 mol) in anhydrous DMSO (50 $cm^3$) was prepared. To this solution, 1,1'-carbonyldiimidazole (CDI) (10 g, 0.00617 mol) was added slowly. Once the evolution of $CO_2$ had ceased, this solution was added to the LBG/DMSO/LiCl solution with stirring. The reaction mixture was maintained at 65° C. for 24 hours. It was then poured into a threefold volume of methanol, causing the product to precipitate. This was collected on a sinter funnel, then redispersed into methanol, filtered and washed with copious amounts of methanol. The product was dried under vacuo at 60° C for 48 hours, yielding 8 g of a creamy, crystalline solid.

Reaction scheme 1:

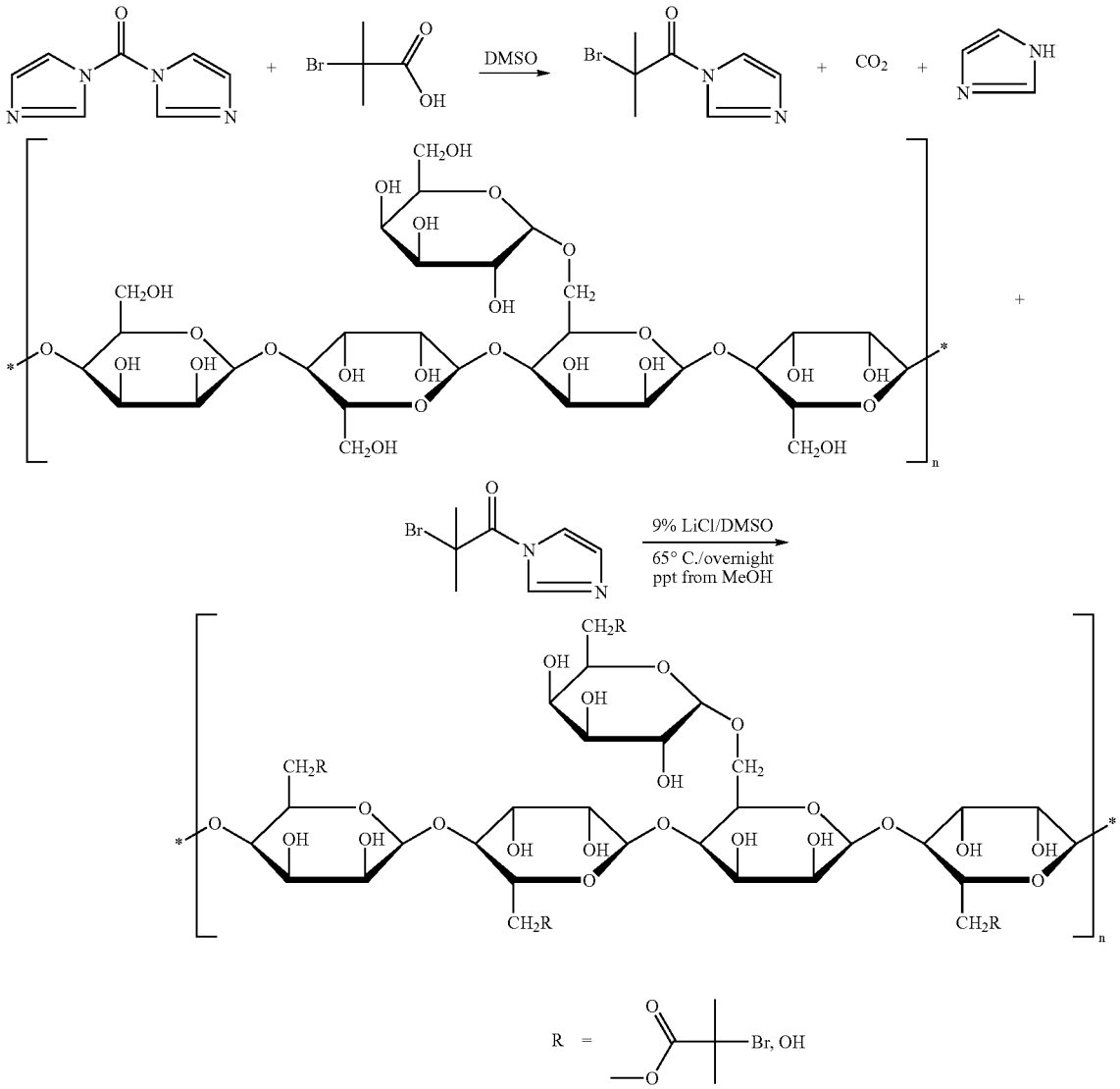

Characterisation

IR: 1736 $cm^{-1}$ (s, saturated ester carbonyl) NMR ($^1H$-$D_2O$): 1.84 (d, ester $CH_3$, 6H); 3.4–4.6 (m, mannose/galactose CH and $CH_2$, 90H) 10 From the nmr, the average degree of substitution (DS) is 1 ester group for every 15 Locust Bean Gum sugar rings.

1.2 Preparation of Locust Bean Gum-graft-poly(sodium 4-styrenesulphonic acid)

To a 3-necked round bottom flask fitted with a $N_2$ inlet and outlet and a thermometer were added Locust Bean Gum-macroinitiator (3 g, $1.19\times10^{-3}$ mol), sodium 4-styrenesulphonic acid (12.31 g, 0.0597 mol) and a magnetic stirrer bar. The solids were dissolved in demineralised water (50 $cm^{-3}$) and the resulting solution de-gassed by bubbling nitrogen gas through for 45 minutes. A mixture of copper (I) bromide (0.1713 g, $1.19\times10^{-3}$ mol) and 2,2'-dipyridyl (0.3773 g, $\mathbf{2.39\times10^{-3}}$ mol) was added to the reaction flask. A polymerisation exotherm of 10° C. was noted.

The reaction was stirred for 2 hours at ambient temperature. The contents of the flask was then diluted with demineralised water and the solution passed through a bed of silica on a sinter funnel, yielding a water-white, clear solution. This was added to a threefold volume of methanol, causing the product to precipitate. This was collected on a filter and dried in vacuo at 40° C. to constant weight, yielding 8 g of white, crystalline powder.

Reaction scheme 2:

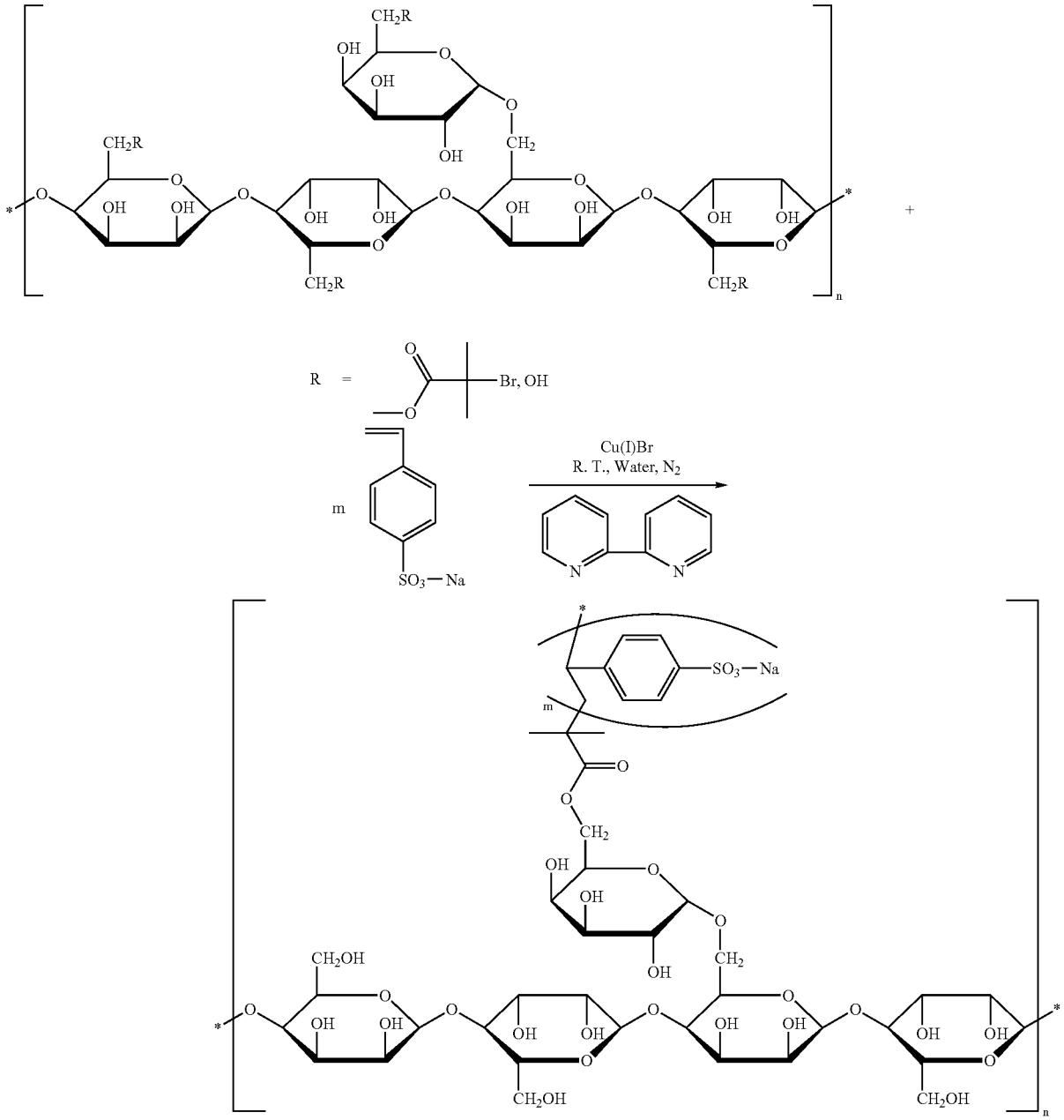

Characterisation:

NMR ($^1$H-$D_2O$)/ppm: 0.9–2.4 (bm, vinylic polymer backbone); 3.2–4.4 (bm, mannose/galactose CH's and $CH_2$'s); 6.1–7.0 (bm) and 7.3–7.9 (bm, aryl CH's).

Example 2

Antiredeposition Benefits

Method of Measuring Redeposition

The method involved the use of a tergotometer and multiple washing in order to simulate the redeposition process that occurs with repeated washing either under difficult wash conditions or with low efficiency wash products.

Test formulations were used to wash pre-soiled "test cloths" together with clean fabrics (redeposition monitors) under standard conditions. The soiled fabrics were used to supply soil to the system and also to measure the cleaning efficiency of the formulations. The clean fabrics were used to "collect" soil from the liquor and were used to quantify the level of soil redeposition. After washing, the test cloths and redeposition monitors were dried and their reflectance measured. A new batch of test cloths was then washed together with the redeposition monitors from the original wash cycle and the process repeated to give information on the level of redeposition after two wash cycles. This process was then repeated for a third, fourth (etc) wash cycle:

Cycle 1: test cloths, clean antiredeposition monitors

Cycle 2: test cloths, antiredeposition monitors from Cycle 1

Cycle 3: test cloths, antiredeposition monitors from Cycle 2

Cycle 4: test cloths, antiredeposition monitors from Cycle 3 . . .

Cycle n: test cloths, antiredeposition monitors from Cycle n-1

This protocol allows both the detergency and the redeposition process to be followed as a function of cycle number. The reflectance value falls with successive cycles as more soil is present in the system: the smaller the reflectance decrease, the better the antiredeposition properties of the formulation.

Test Formulations

A stock solution was prepared, using water of 40 degrees French hardness, containing 2 g/l of the following notional formulation (equivalent to 1.77 g/l of the specified ingredients the rest comprising other detergent ingredients such as water, enzyme, fluorescer, perfume etc.

| Ingredient | Weight % |
|---|---|
| Sodium linear alkylbenzene sulphonate LAS (100%) | 26.00 |
| Sodium tripolyphosphate | 24.02 |
| Sodium sulphate | 18.14 |
| Sodium carbonate | 10.85 |
| Sodium alkaline silicate (48%) as 100% by weight | 4.66 |
| (Water | to 100) |

The following formulations were tested:

| Example | |
|---|---|
| Comparative Example A | Formulation as above |
| Comparative Example B | Formulation as above plus 1.5 wt % of sodium carboxymethyl cellulose |
| Example 2 | Formulation as above plus 1.5 wt % of the polymer of Example 1 |

For each product tested there were 3 replicates.

Test Cloths

The soiled test cloths (detergency monitors) were 7.5 cm×7.5 cm squares as follows:

| Fabric | Soil |
|---|---|
| Cotton | Nut oil and iron oxide (black) |
| Cotton | Kaolin and sebum |
| Polyester | Kaolin and sebum |
| Cotton | Carbon black and mineral oil |

The clean test cloths (antiredeposition monitors) were 10 cm×10 cm squares of the following fabrics:

knitted cotton woven cotton polyester

Test Wash Procedure

The tergotometer pots containing the test formulations, soiled and clean test cloths at 25° C. were agitated at 90 rpm for 15 minutes. The fabric bundles were then removed from the pots and rinsed twice in water (40 degrees French hard). the fabrics were then dried in the dark for at least 12 hours.

The reflectance values of the redeposition monitors were measured (full spectrum with ultraviolet) excluded) before and after the wash.

The procedure was repeated for 8 cycles and reflectance measured at the end of each cycle.

Redeposition Results

The following table shows mean reflectance values after 3 wash cycles:

| Example | Antiredeposition agent | Number of replicates | Reflectance change)R460 |
|---|---|---|---|
| A | None | 3 | −4.87 |
| B | SCMC | 6 | −3.19 |
| 2 | Example 1 polymer | 3 | −2.50 |

Examples 3 to 6

Laundry Detergent Formulations

The following are examples of laundry detergent formulations in accordance with the invention.

Example 3

Laundry Liquid

| Ingredient | wt % |
|---|---|
| monoethanolamine | 0.23 |
| sodium citrate | 3.20 |
| coconut fatty acid | 0.77 |
| sodium linear alkylbenzene sulphonate | 6.00 |
| nonionic surfactant (alcohol ethoxylate, 9EO) | 6.60 |
| sodium lauryl ether sulphate | 10.50 |
| propylene glycol | 4.75 |
| sorbitol | 3.35 |
| borax | 2.30 |
| polymer of Example 1 | 1.5 |
| fluorescer | 0.125 |
| polymer, acrylate/styrene | 0.30 |
| protease, lipase | 0.70 |
| perfume | 0.2 |
| Water | to 100 |

Example 4

Non-Phosphate Heavy Duty Laundry Powder

| Ingredient | wt % |
|---|---|
| Na linear alkylbenzene sulphonate (as 100%) | 8.4 |
| Nonionic surfactant 7EO | 6.5 |
| Na carbonate | 11.7 |
| Zeolite MAP (anhydrous basis) | 21.6 |
| Na sulphate | 14.5 |
| Na silicate (as 100%) | 0.85 |
| Soap | 1.47 |
| Tetraacetyl ethylene diamine (83%) | 2.71 |
| Na percarbonate | 15.00 |
| Ethylenediamine tetramethylene phosphonate | 0.72 |
| Na carbonate/silicate cogranule | 3.6 |
| Antifoam granule | 1.22 |
| Moisture & salts | 5.17 |
| Polymer of Example 1 | 1.5 |
| Soil release polymer (sulphonated polyester) | 0.12 |
| Anti dye transfer polymer (polyvinyl pyrrolidone) | 0.08 |
| Acrylic/maleic copolymer | 1.3 |
| Fluorescer, enzymes (protease, lipase, amylase, cellulase), perfumes, minor ingredients | to 100 |

Examples 5 and 6

Laundry Tablets

| Ingredient | Example 5 Non-phosphate tablet | Example 6 Phosphate tablet |
|---|---|---|
| Na linear alkylbenzene sulphonate | 9.33 | 9.48 |
| Nonionic surfactant | 4.1 | 4.19 |
| Soap | 0.73 | 0.29 |
| Sodium tripolyphosphate | — | 51.00 |
| zeolite MAP (anhydrous basis) | 20.86 | — |
| Na citrate | 2.5 | — |

-continued

| Ingredient | Example 5 Non-phosphate tablet | Example 6 Phosphate tablet |
|---|---|---|
| Na acetate | 26.43 | — |
| Na carbonate | 3.1 | — |
| Na disilicate (as 100%) | 2.0 | 3.48 |
| Antifoam granule (100%) | 0.3 | 0.425 |
| Na percarbonate (100%) | 13.35 | 12.46 |
| Tetraacetyl ethylenediamine (100%) | 4.2 | 2.35 |
| Ethylenediamine tetramethylene phosphonate | 0.34 | 0.46 |
| Polyvinyl pyrrolidone (100%) | 0.19 | 0.143 |
| Soil release polymer (sulphonated polyester) | 0.25 | 0.11 |
| Polymer of Example 1 | 1.5 | 1.5 |
| Enzymes (protease, lipase, cellulase), fluorescer, perfume, minor ingredients, water | to 100 | to 100 |

The invention claimed is:

1. A built laundry detergent composition comprising (a) from 5 to 60 wt % of an organic detergent surfactant selected from anionic, nonionic, cationic, zwitterionic and amphoteric surfactants and combinations thereof, (b) from 10 to 80 wt % of a detergency builder, (c) from 0.1 to 10 wt % of a graft polymer having a locust bean gum backbone and grafts of an aromatic sulphonic acid, (d) optionally other detergent ingredients to 100 wt %.

2. A detergent composition as claimed in claim 1, wherein the laundry detergent composition is a granular or particulate composition.

3. A detergent composition as claimed in claim 1, wherein the laundry detergent composition is a liquid.

4. A particulate laundry detergent composition comprising (a) from 5 to 60 wt % of an organic detergent surfactant selected from anionic, nonionic, cationic, zwitterionic and amphoteric surfactants and combinations thereof, (b) optionally from 0 to 80 wt % of a detergency builder, (c) from 0.1 to 10 wt % of a graft polymer having a locust bean gum backbone and grafts of an aromatic sulphonic acid, (d) optionally other detergent ingredients to 100 wt %.

5. A laundry detergent composition as claimed in claim 1, wherein the graft polymer is locust bean gum—graft—poly (4-styrenesulphonic acid).

6. A detergent composition as claimed in claim 1, wherein the organic detergent surfactant (a) comprises an anionic sulphonate or sulphonate surfactant optionally in admixture with one or more cosurfactants selected from ethoxylated nonionic surfactants, non-ethoxylated nonionic surfactants, ethoxylated sulphate anionic surfactants, cationic surfactants, amine oxides, alkanolamides and combinations thereof.

7. A detergent composition as claimed in claim 1, which comprises a detergency builder (b) selected from zeolites, phosphates, and citrates.

8. A detergent composition as claimed in claim 1, wherein the laundry detergent composition comprises other detergent ingredients (d) selected from bleach ingredients, enzymes, sodium carbonate, sodium silicate, sodium sulphate, foam controllers, foam boosters, perfumes, fabric conditioners, soil release polymers, dye transfer inhibitors, photobleaches, fluorescers and coloured speckles.

* * * * *